US011384750B2

(12) United States Patent
Wu

(10) Patent No.: US 11,384,750 B2
(45) Date of Patent: Jul. 12, 2022

(54) HOSE PUMP ROTOR

(71) Applicant: HEFEI HUAYUN MACHINERY MANUFACTURING CO., LTD., Anhui (CN)

(72) Inventor: Jun Wu, Anhui (CN)

(73) Assignee: HANGZHOU SHINEDO BIOTECH CO., LTD., Hangzhou (CN)

( * ) Notice: Subject to any disclaimer, the term of this patent is extended or adjusted under 35 U.S.C. 154(b) by 149 days.

(21) Appl. No.: 16/493,246

(22) PCT Filed: Mar. 13, 2018

(86) PCT No.: PCT/CN2018/078851
§ 371 (c)(1),
(2) Date: Sep. 11, 2019

(87) PCT Pub. No.: WO2018/166446
PCT Pub. Date: Sep. 20, 2018

(65) Prior Publication Data

US 2020/0116144 A1 Apr. 16, 2020

(30) Foreign Application Priority Data

Mar. 13, 2017 (CN) ..... 201710146816.9

(51) Int. Cl.
*F04B 43/08* (2006.01)
*F04B 43/12* (2006.01)
*F04B 43/00* (2006.01)

(52) U.S. Cl.
CPC ..... *F04B 43/1253* (2013.01); *F04B 43/0072* (2013.01); *F04B 43/0081* (2013.01);
(Continued)

(58) Field of Classification Search
CPC ..... F04B 43/1253; F04B 43/0072; F04B 43/0081; F04B 43/08; F04B 43/1238;
(Continued)

(56) References Cited

U.S. PATENT DOCUMENTS 315,667 A * 4/1885 Serdinko ..... F04B 43/1253 417/475
459,053 A * 9/1891 Truax ..... F04B 43/1253 417/477.8
(Continued)

FOREIGN PATENT DOCUMENTS

CH 453080 A * 5/1968 ..... F04B 43/1276
CN 202991417 U 6/2013
(Continued)

OTHER PUBLICATIONS

Machine Translation of CH 453080 A to Binder, Jean-Charles, published May 31, 1968 (Year: 1968).*

*Primary Examiner* — Essama Omgba
*Assistant Examiner* — Dnyanesh G Kasture
(74) *Attorney, Agent, or Firm* — Foley & Lardner LLP

(57) ABSTRACT

A hose pump rotor includes a main rotating shaft. The main rotating shaft includes a main shaft and a rotor base which are fixedly connected to each other, roller support arms are symmetrically arranged on the rotor base and outer ends thereof are connected to rollers, with axes of the rollers being parallel to an axis of the main shaft, the roller support arms and the rotor base form a radially-displaceable limiting fit, and the roller support arms and the rotor base form a locking fit. The rotor base includes a groove enclosed by a bottom plate and side plates disposed on opposite sides thereof, wherein the bottom plate is fixedly connected to the main shaft.

6 Claims, 5 Drawing Sheets

(52) U.S. Cl.
CPC ..... *F04B 43/08* (2013.01); *F04B 43/1238* (2013.01); *F04B 2201/1208* (2013.01)

(58) Field of Classification Search
CPC ..... F04B 2201/1208; F04B 43/1269; F04B 43/1276; F04B 45/08
USPC ..... 417/477.8
See application file for complete search history.

(56) References Cited

U.S. PATENT DOCUMENTS

| | | | | |
|---|---|---|---|---|
| 3,447,478 | A * | 6/1969 | Clemens | F04B 43/1276 417/477.8 |
| 4,484,864 | A * | 11/1984 | Michel | F04B 43/1253 417/477.8 |
| 4,545,744 | A | 10/1985 | Weber et al. | |
| 4,558,996 | A | 12/1985 | Becker | |
| 5,759,017 | A | 6/1998 | Patton et al. | |
| 2018/0003168 | A1 | 1/2018 | Yaeguchi et al. | |

FOREIGN PATENT DOCUMENTS

| | | | |
|---|---|---|---|
| CN | 104696204 | A | 6/2015 |
| CN | 106640608 | A | 5/2017 |
| CN | 106930929 | A | 7/2017 |
| CN | 206555108 | U | 10/2017 |
| CN | 206723022 | U | 12/2017 |
| JP | 2016-191371 | A | 4/2018 |

* cited by examiner

HOSE PUMP ROTOR

This application is a National Stage of PCT/CN2018/078851, filed Mar. 13, 2018, which claims priority to CN 201710146816.9, filed Mar. 13, 2017 which are incorporated herein by reference in their entirety.

TECHNICAL FIELD

The present invention relates to a hose pump, and more particularly to an improved structure of a hose pump rotor.

BACKGROUND ART

Hose pumps in the prior art are widely used in the chemical industry and other industrials, and the basic structure thereof comprises a housing and a hose placed inside the housing, wherein a rotor support, which is driven to rotate by a main shaft, drives rollers to squeeze the hose to pump a medium. During the working process, there are special requirements for the extent to which the hose is rolled by the rollers, that is, the amount of deformation of the hose, which is closely related to the pumping flow rate and the material of the hose. This requires the rollers to be displaceable in a radial direction for adjustment, to ensure the extent to which the hose is squeezed. In addition, in the early, middle and late stages of use, since the elasticity of the hose varies, whether the position of the roller can be adjusted in the radial direction to obtain the appropriateness for the roller rolling the hose is an urgent technical problem to be solved in the industry.

SUMMARY OF THE INVENTION

An object of the present invention is to provide a hose pump rotor, which facilitates the adjustment of the positions of rollers in a radial direction such that a hose is squeezed to a moderate extent.

In order to achieve the above object, the following technical solution is used in the present invention: a hose pump rotor, wherein a main rotating shaft comprises a main shaft and a rotor base which are fixedly connected to each other, roller support arms are symmetrically arranged on the rotor base and outer ends thereof are connected to rollers, with axes of the rollers being parallel to an axis of the main shaft, the roller support arms and the rotor base form a radially-displaceable limiting fit, and the roller support arms are fixedly connected to the rotor base via locking components.

With the above technical solution, the roller support arms can be displaced in the radial direction on the rotor base and can be fixed by locking same via the locking components, so that the positions of the roller support arms can be adjusted when needed. That is to say, the positions where the rollers are fitted to the hose are adjusted, so that the force exerted by the rollers on the hose can be ensured, and normal operation of the hose can be guaranteed.

DETAILED DESCRIPTION OF EMBODIMENTS

Figure 1:
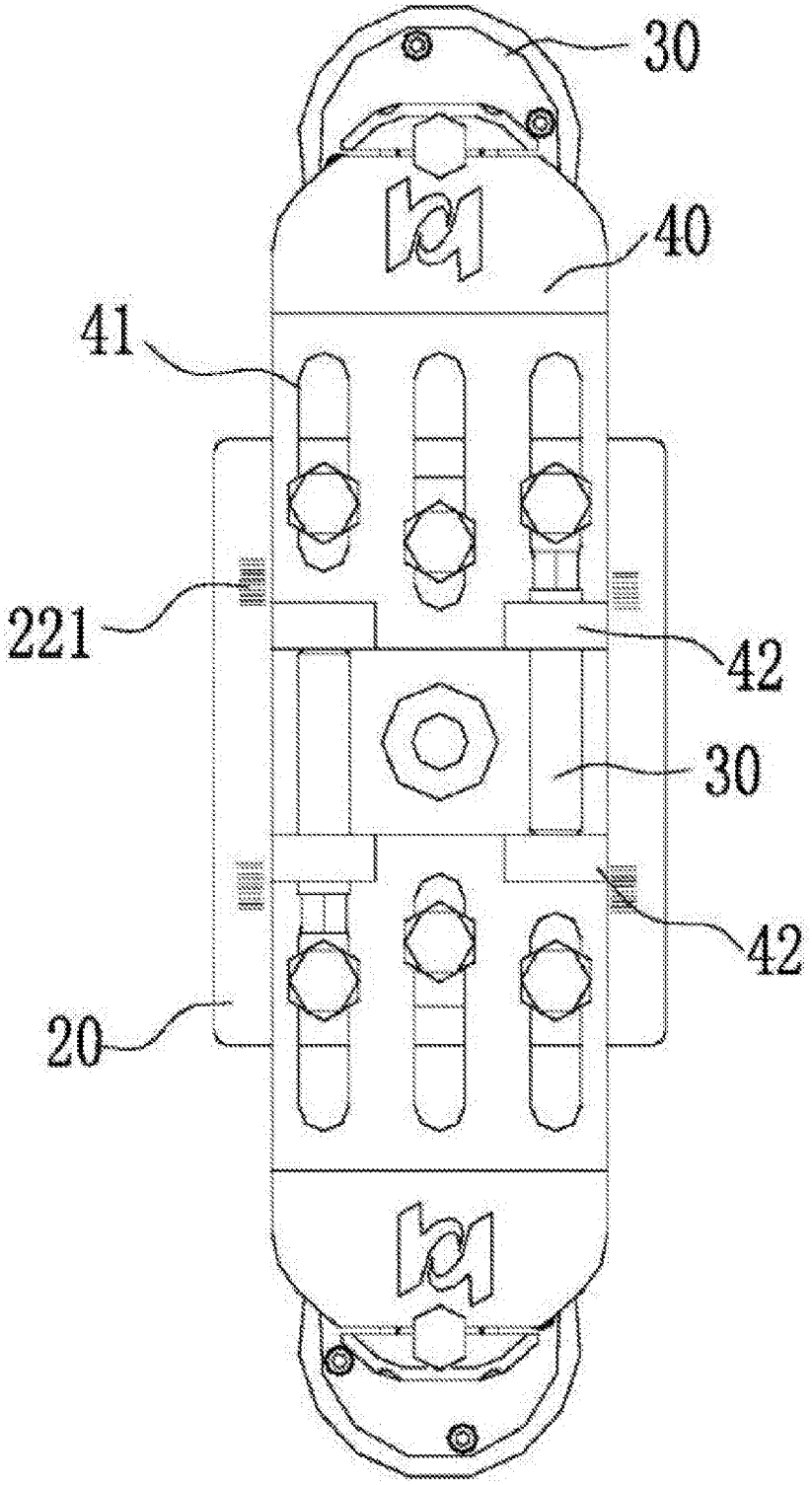
FIG. 1 is a front view of the present invention.
Figure 2:
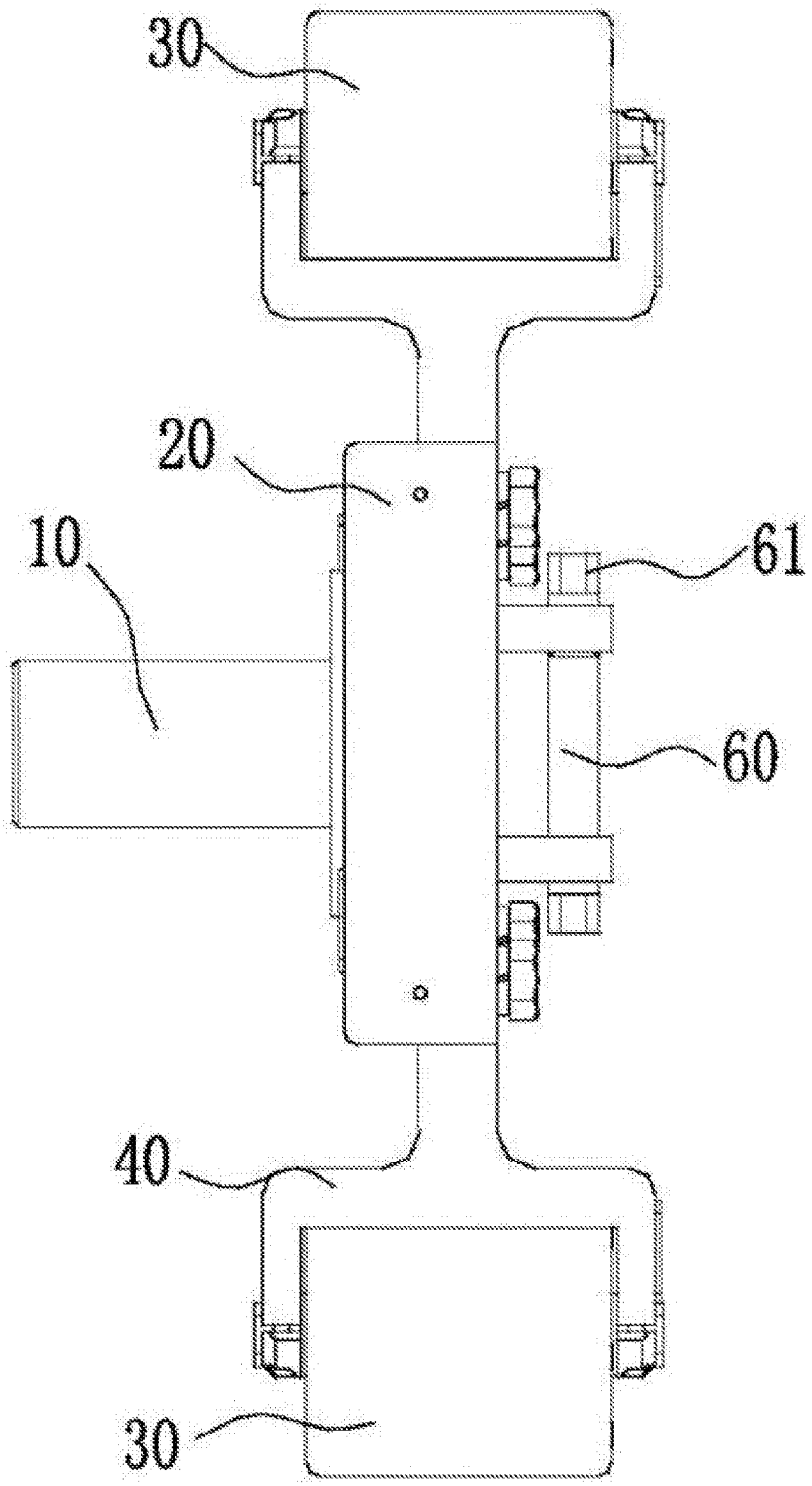
FIG. 2 is a right view of FIG. 1.
Figure 3:
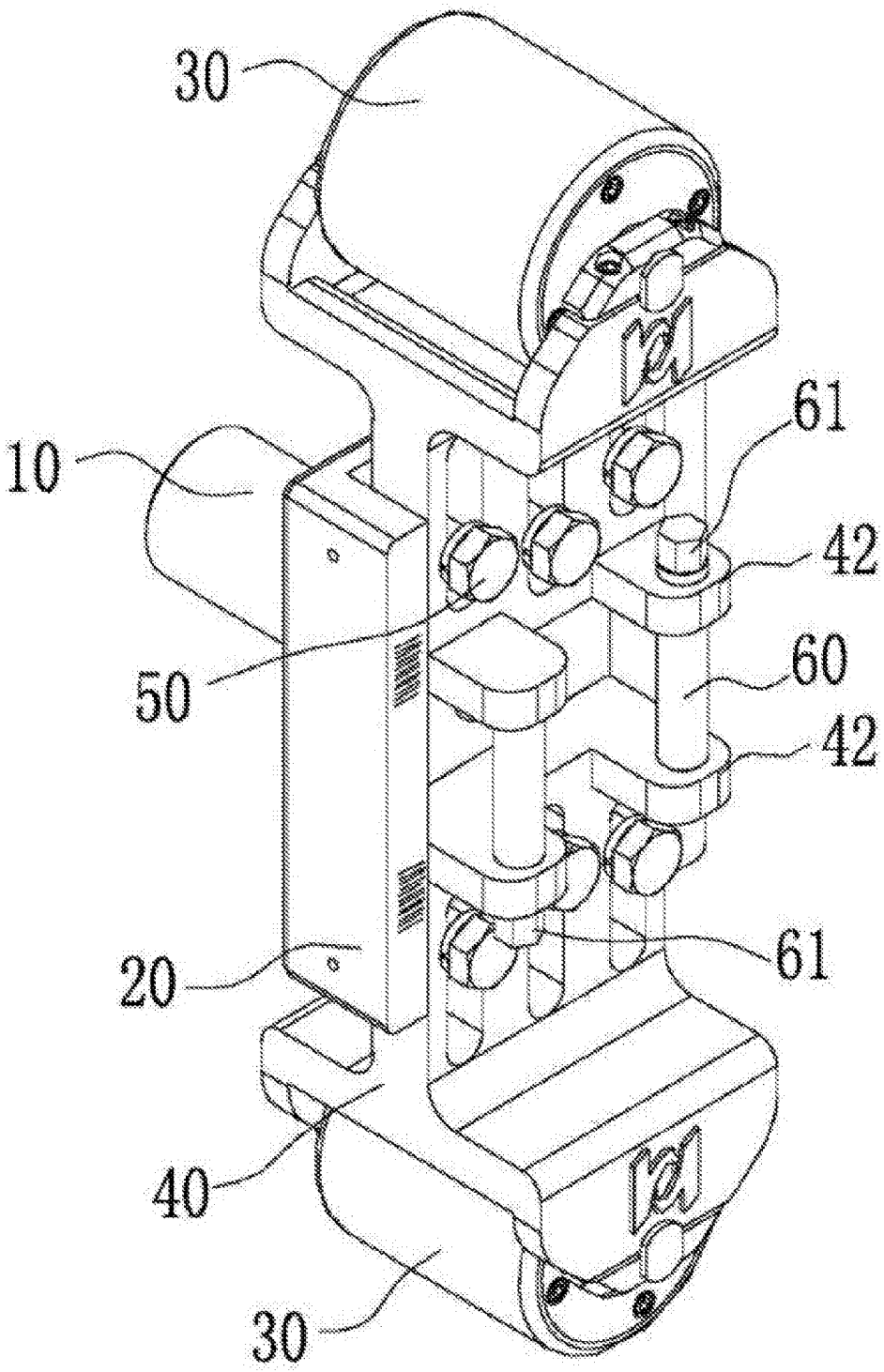
FIG. 3 is a perspective view of the present invention.
Figure 4:
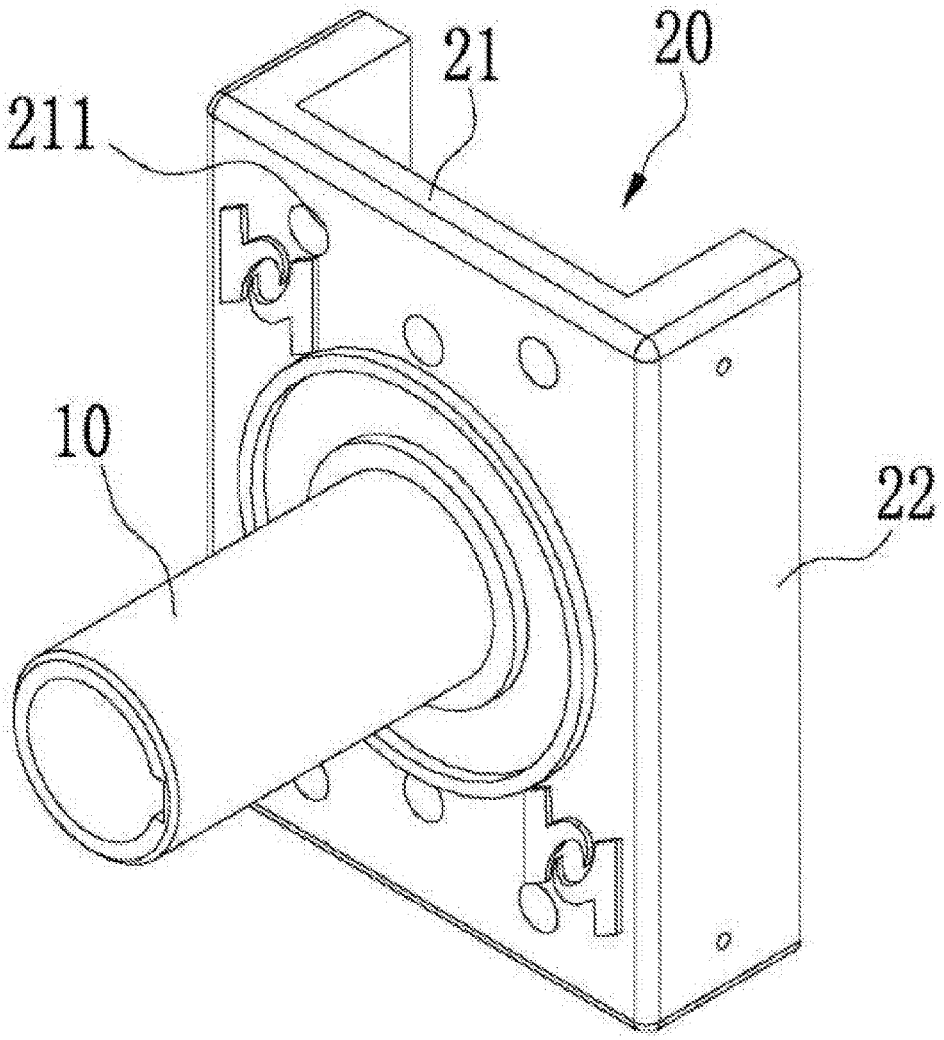
FIG. 4 is a perspective view of a main shaft and a rotor base of the present invention, respectively.
Figure 5:
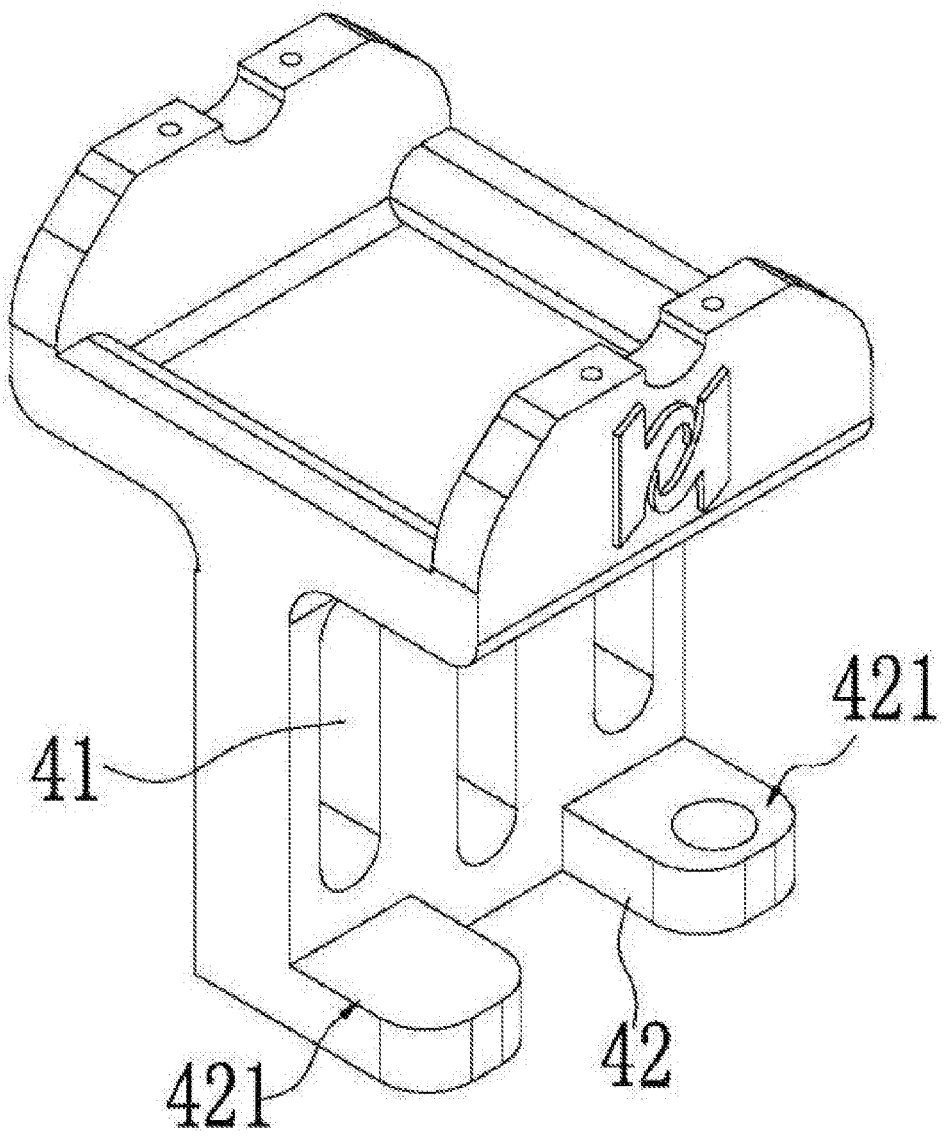
FIG. 5 is a perspective view of a roller support arm of the present invention, respectively.

In a hose pump rotor shown in FIGS. 1-5, a main rotating shaft comprises a main shaft 10 and a rotor base 20 which are fixedly connected to each other, roller support arms 40 are symmetrically arranged on the rotor base 20 and outer ends thereof are connected to rollers 30, with axes of the rollers 30 being parallel to an axis of the main shaft 10, the roller support arms 40 and the rotor base 20 form a radially-displaceable limiting fit, and the roller support arms 40 are fixedly connected to the rotor base 20 via locking components. In the above solution, the so-called radially-displaceable limiting fit means that the roller support arms 40 and the rotor base 20 can move relative to each other in a radial direction and can only move in the determined radial direction.

The main shaft 10 and the rotor base 20 can be independently machined in the form of split structures and then fixedly connected in one piece, an electric motor drives the main shaft 10 to rotate, and the rotor base 20 rotates synchronously along with the main shaft and drives the roller support arms 40 and the rollers 30 connected thereto to rotate. When rotating, the rollers 30 intermittently come into contact with and roll the hose to realize a task of pumping a medium. Since the roller support arms 40 and the rotor base 20 form the radially-displaceable limiting fit, the roller 30 can be adjusted to implement displacement adjustment in the radial direction of the rotor as needed to ensure the force by which the rollers 30 roll the hose, and thereby the pumping efficiency of the hose under normal operating conditions, which can increase the service life of the hose.

As a preferred solution, the rotor base 20 is in the form of a groove enclosed by a bottom plate 21 and side plates 22 disposed on opposite sides thereof, wherein the bottom plate 21 is fixedly connected to the main shaft 10, and a groove length direction of a groove cavity on the rotor base 20 is consistent with the radial direction of the main shaft 10. In this solution, the groove structure is preferably used as a guide constraint of the limiting fit, which is not only simple in structure, but also facilitates assembly operation.

Inner segments of the roller support arms 40 are located inside the groove cavity of the rotor base 20, and the roller support arms and the rotor base form a radially-movable fit. Connection bolts 50 are disposed between the roller support arms 40 and the bottom plate 21 and/or the side plates 22 of the rotor base 20 to form locking components; and the outer ends of the roller support arms 40 are located outside outer ends of the groove cavity of the rotor base 20. After the roller support arms 40 are adjusted in place, they are locked and fixedly connected by the connection bolts 50, ensuring the stable positions of the rollers 30.

As a specific preferred solution, the roller support arms 40 are in the shape of a strip plate, inside plate surfaces of the roller support arms 40 are attached to an in-cavity plate surface of the bottom plate 21, and two side plate surfaces of the roller support arms 40 are attached to in-cavity plate surfaces of the side plates 22 of the rotor base 20; strip-shaped holes 41 are formed in the plate surfaces of the roller support arms 40, the length direction of the strip-shaped holes 41 being consistent with the radial direction; and connection holes 211 are formed in the plate surface of the bottom plate 21, and the strip-shaped holes 41 positionally correspond to the connection holes 211 and allow the connection bolts 50 to implement connection.

In the above solution, the roller support arms 40 are configured to be in an attachment fit with both the groove bottom and groove walls of the rotor base 20, that is, a three-surface-contact-type limiting fit between the roller support arms and the rotor base, leaving a movement adjustment in the radial direction to ensure the dynamic balance of the rotor.

As a preferred solution, the two roller support arms 40 are symmetrically arranged with the main shaft 10 as the center, outside plate surfaces of the roller support arms 40 are provided with bumps 42, and adjustment lead screws 60 are disposed between the bumps 42 of the two roller support arms 40. The above solution is based on the fact that limiting grooves of the roller support arms 40 are straight grooves, which facilitates both machining and adjustment, in particular, the provision of the bumps 42 for arranging the lead screws 60 allows the lead screws 60 and heads of the bolts 50 to be in clearance positions and enables continuously variable adjustment of the spacing between the roller support arms 40, to obtain the optimum force by which the rollers 30 roll the hose.

As a preferred solution, three strip-shaped holes 41 are arranged apart from one another on the plate surface of each roller support arm 40, and the connection holes 211 are disposed corresponding to the strip-shaped holes 41.

Two bumps 42 are arranged apart from each other on the roller support arm 40 in a plate width direction, and one adjustment lead screw 60 is disposed between the bumps 42 of the roller support arms 40 on the same side. This can ensure that the two roller support arms 40 synchronously move close to or away from each other in the radial direction with respect to the axis of the rotor, which ensures that the forces by which both of the rollers 30 roll the hose are the same, i.e., ensuring the stability of the flow rate of the medium pumped, avoiding fluctuation of the rolling force applied to the hose, and then ensuring that the amount of deformation of the hose is stable and controllable.

In order to facilitate the assembly and adjustment, edges, at a groove opening, of the side plates 22 of the rotor base 20 are provided with rulers 221; the bumps 42 are provided with marking scales 421, and the marking scales 421 on the bumps 42 may also be formed by bump surfaces themselves; and the rulers 221 are arranged adjacent and corresponding to the marking scales 421. The corresponding arrangement of the above-mentioned rulers 221 and marking scales 421 can provide convenience when a hose pump is being assembled, that is, the hose is first arranged inside the pump housing and is fixed with a hose end thereof. At this time, since there is no squeezing from the rollers 30, the hose can be installed easily and conveniently. Whether the rotor is installed in advance or later, the roller support arms 40 are first adjusted to the approximate positions, that is, the rollers 30 are adjusted to the initial installation positions, and the rollers 30 at the installation initial positions have no interference or substantially no interference with the hose. After completing the installation of the hose, the positions of the roller support arms 40 on the rotor base 20 are adjusted, and whether the rollers 30 have reached the design positions can be easily determined by observing the corresponding positions of the rulers 221 and the marking scales 421.

The invention claimed is:

1. A hose pump rotor, wherein a main rotating shaft comprises a main shaft and a rotor base which are fixedly connected to each other, roller support arms are symmetrically arranged on the rotor base and outer ends thereof are connected to rollers, with axes of the rollers being parallel to an axis of the main shaft, the roller support arms and the rotor base form a radially-displaceable limiting fit, and the roller support arms and the rotor base form a locking fit, wherein the rotor base comprises a groove enclosed by a bottom plate and side plates disposed on opposite sides thereof, wherein the bottom plate is fixedly connected to the main shaft, and a groove length direction of a groove cavity on the rotor base extends in a radial direction of the main shaft, and wherein each of the roller support arms comprises an elongated plate, a bottom surface of the elongated plate of each roller support arm is slidably supported by an in-cavity plate surface of the bottom plate, and two side surfaces of the elongated plate of the roller support arms slidably engage in-cavity plate surfaces of the side plates of the rotor base; oval shaped holes are formed in surfaces of the elongated plates of the roller support arms, the oval shaped holes extend in a radial direction of the main shaft; and connection holes are formed in the plate surface of the bottom plate, and the oval shaped holes are superimposed on the connection holes when the support arms are installed on the rotor base and allow connection bolts to implement connection.

2. The hose pump rotor according to claim 1, wherein inner segments of the roller support arms are located inside the groove cavity of the rotor base, and the roller support arms and the rotor base form a radially-displaceable limiting fit; connection bolts are disposed between the roller support arms and the bottom plate and/or the side plates of the rotor base to form the locking fit; and the outer ends of the roller support arms are located outside outer ends of the groove cavity of the rotor base.

3. The hose pump rotor according to claim 1, wherein two roller support arms are symmetrically arranged on the rotor base, outside plate surfaces of the roller support arms are provided with bumps, and adjustment lead screws are disposed between the bumps of the two roller support arms.

4. The hose pump rotor according to claim 3, wherein two bumps are arranged apart from each other on each of the two roller support arms in a plate width direction, and one of the adjustment lead screws is disposed between a bump on one of the two roller support arms and a corresponding bump on the other of the two roller support arms.

5. The hose pump rotor according to claim 3, wherein edges, at a groove border, of the side plates of the rotor base are provided with rulers, the bumps are provided with marking scales, and the rulers are arranged adjacent and corresponding to the marking scales.

6. The hose pump rotor according to claim 1, wherein three strip-shaped holes are arranged apart from one another on the plate surface of each roller support arm, and the oval shaped holes are superimposed on the connection holes when the support arms are installed on the rotor base.

* * * * *